US006302270B1

(12) United States Patent
Diaz et al.

(10) Patent No.: US 6,302,270 B1
(45) Date of Patent: Oct. 16, 2001

(54) PACKAGING CARTON FOR A LUMINAIRE

(75) Inventors: José Diaz; Thierry Fleury, both of Nevers; Serge Lavergne, La Machine, all of (FR)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/567,485

(22) Filed: May 9, 2000

(30) Foreign Application Priority Data

May 11, 1999 (FR) ..... 99 06016

(51) Int. Cl.[7] ..... B65D 85/42
(52) U.S. Cl. ..... 206/418
(58) Field of Search ..... 206/224, 349, 206/371, 461, 418

(56) References Cited

U.S. PATENT DOCUMENTS 4,294,354 * 10/1981 Ariga .
5,064,056 * 11/1991 Gresh .
5,733,612 * 3/1998 Garry .
6,155,413 * 12/2000 Bilanchone .

* cited by examiner

*Primary Examiner*—David T. Fidei
(74) *Attorney, Agent, or Firm*—Dicran Halajian

(57) ABSTRACT

A packaging carton holds a luminaire which is to be fixed to any support by fasteners which are to be fixed to the support. The packaging carton has a portion which can be easily detached from the closed packaging. The fasteners are placed in the packaging behind the detachable portion so that they can be removed without the rest of the packaging being opened.

6 Claims, 2 Drawing Sheets

PACKAGING CARTON FOR A LUMINAIRE

BACKGROUND OF THE INVENTION

The invention relates to a packaging carton for a luminaire, which luminaire is designed to be fastened to a support of any kind by means of intermediate pieces which are to be fixed to said support, said pieces being provided with means into which the luminaire can be hooked.

SUMMARY OF THE INVENTION

It is an object of the invention to protect the luminaire during the operations which precede its final mounting and to facilitate this mounting.

To achieve this object, the packaging carton comprises a portion which can be easily detached from the closed packaging, and said intermediate pieces are placed in the packaging carton behind said detachable portion and are removable so that they can be taken out without the rest of the packaging being opened.

Special embodiments of the invention will become apparent from the dependent claims 2 and 3.

These as well as other, more detailed aspects of the invention will become clear from the following description of an embodiment which is given by way of non-limitative example.

DETAILED DESCRIPTION OF THE PREFERRED EMBODIMENTS

Figure 1:
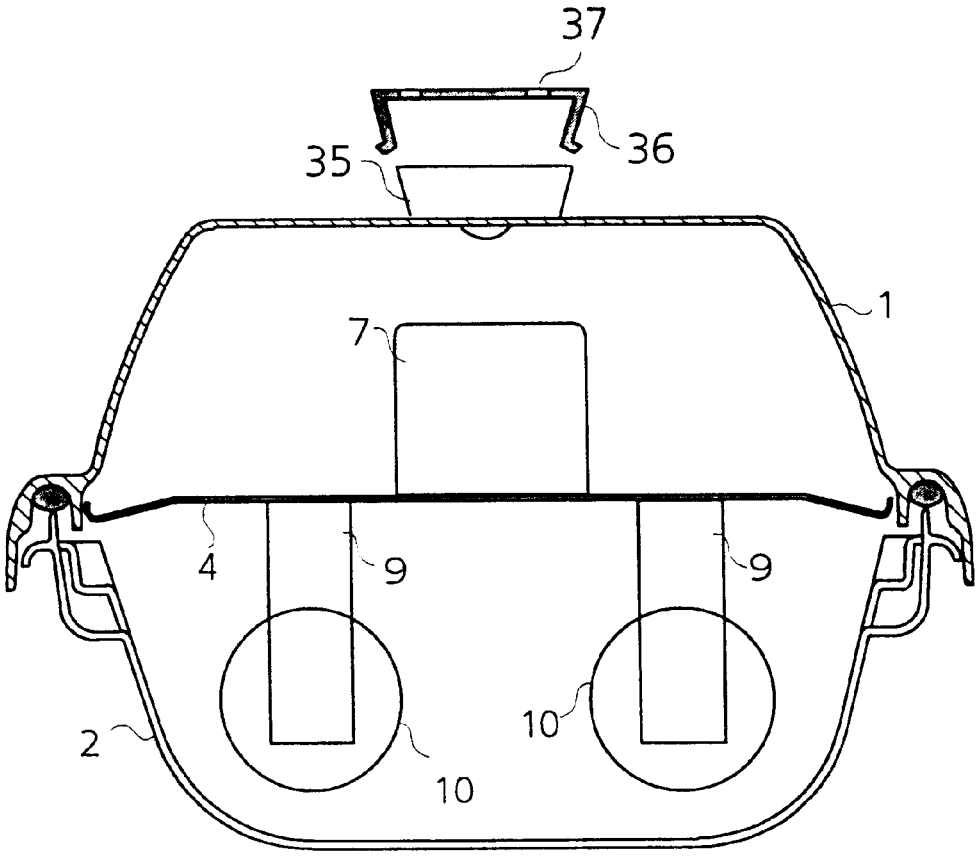
FIG. 1 shows an assembled luminaire in cross-section.

The luminaire in FIG. 1 comprises inter alia a housing comprising a half shell 1 referred to as "roof" and provided with fastening means 35 for fastening to a support of any kind, for example a ceiling or a wall, said means having the shape here of a trapezoidal block which is attached to the roof 1 (they may, however, have alternative known shapes, for example, be integrated in the roof, molded together therewith), a transparent half shell or "cover" 2, a plate 4 made from profiled metal sheeting and supporting internal functional elements of the luminaire: inter alia a ballast 7, and lampholders 9 for fluorescent tubes 10.

A clip 36 is formed, for example, from a piece of spring steel and has the shape of an open trapezoid with holes 37 through which fastening screws can be passed to a ceiling or a wall, into which clip the luminaire can be hooked by means of its block 35 of trapezoidal shape.

Figure 2:
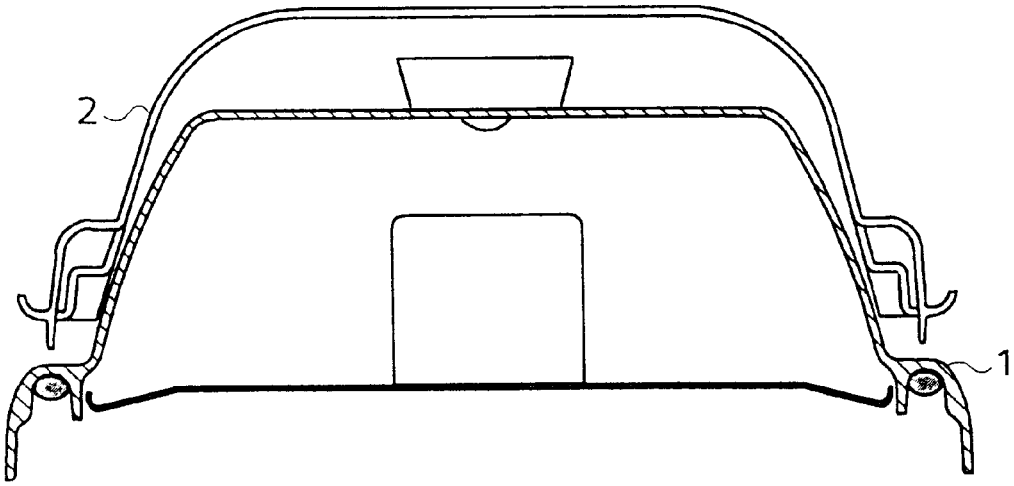
FIG. 2 shows a luminaire in a configuration designed for its packaging, storage, and transport in cross-section.

In FIG. 2, the cover 2 has been turned upside down and is put on top of the housing 1 in that position, and the lampholders 9 have been pushed up. The assembly is thus less high and can be packaged in a smaller carton, which renders its transport and storage more economical.

Figure 3:
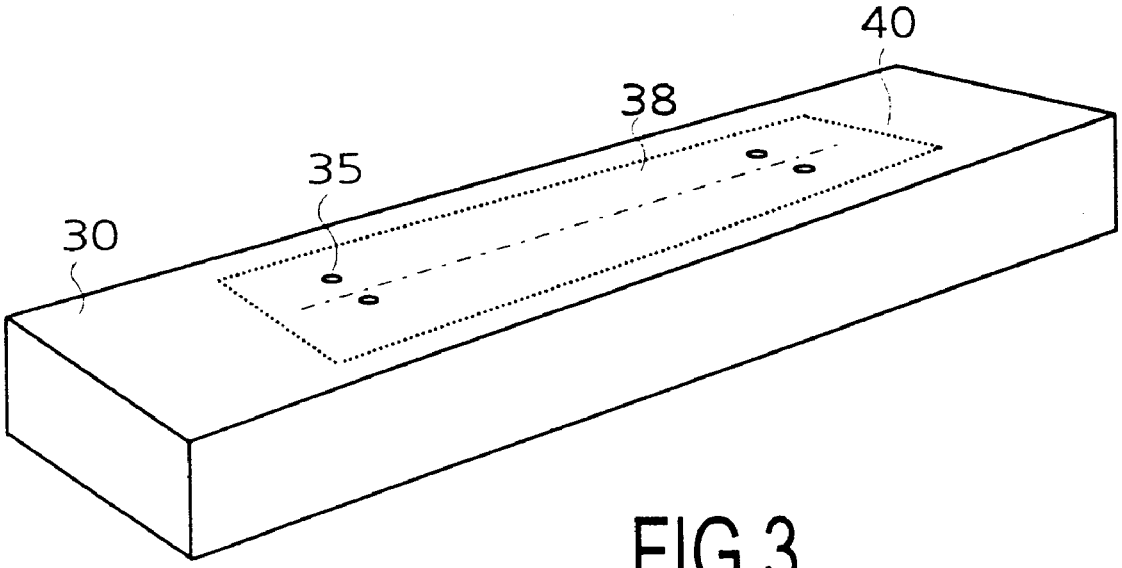
FIG. 3 shows a packaging in perspective view.

In FIG. 3, an easily detachable portion 38 of the packaging 30, which here has the shape of a rectangular box, is included in the upper wall, for example made of cardboard, of this packaging and is surrounded by a line 40 along which the carton has been given incisions, so that a rectangle 38 can be easily detached. This rectangle has in addition been provided with a drawing which serves as a template for piercing holes, in particular indicating the positions of the holes 37 for fastening the clips 35 against a ceiling or a wall.

Figure 4:
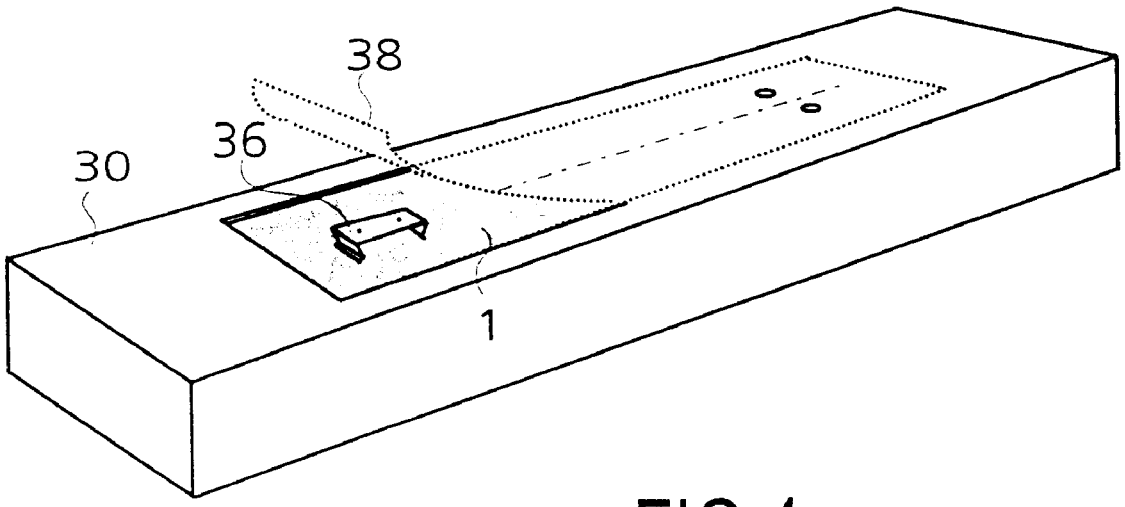
FIG. 4 shows a packaging containing a luminaire in the process of unpacking in perspective view.

In FIG. 4, the cardboard rectangle 38 has been partly detached. Since the fastening clips, one of which is shown 36, are placed behind this portion 38, they are accessible. They are attached by any provisional means, for example with a piece of adhesive tape (not shown), so that an electrical fitter can take out the necessary clips without completely opening the packaging carton, especially without removing the luminaire from the packaging. It is clear that the clip 36 need not necessarily be attached in the packaging carton in the position which it will occupy with respect to the luminaire once the latter is in its operational position. The luminaires may thus be kept packaged, i.e. protected, throughout the period in which the clips are fixed to a ceiling or a wall, during which period the electrical fitter has the clips and their mounting templates available.

It should be noted that the verb "comprise" does not exclude the presence of mother elements or steps besides those listed in any claim.

What is claimed is:

1. A packaging carton for a device which is to be fastened to a support by intermediate pieces which are to be fixed to said support, said intermediate pieces being provided with fastening means into which the device can be hooked, wherein the packaging carton comprises a detachable portion which can be detached from the packaging carton while closed, and said intermediate pieces are placed in the packaging carton behind said detachable portion and are removable so that said intermediate pieces can be taken out without the rest of the packaging carton being opened.

2. A packaging carton as claimed in claim 1, wherein the detachable portion forms part of a wall of the packaging carton and is surrounded by a line of incisions.

3. A packaging carton as claimed in claim 1, wherein the detachable portion carries a drawing which is designed to serve as a template for fixing the intermediate pieces to said support.

4. A packaging carton for holding a fastener and a device to be attached to a support with said fastener comprising a plurality of walls, wherein one of said plurality of walls includes a detachable portion, said fastener being removable from said packaging carton upon detaching said detachable portion, wherein said device remains undisturbed in said packaging carton after removing said detachable portion and said fastener.

5. The packaging carton of claim 4, wherein said detachable portion is formed by incisions on portions of said one of said plurality of walls.

6. The packaging carton of claim 4, wherein said detachable portion includes is configured as a template for attaching said fastener to said support.

* * * * *